United States Patent [19]

Black et al.

[11] 4,267,916

[45] May 19, 1981

[54] COIN IDENTIFICATION SYSTEM

[75] Inventors: Charles H. Black, Chicago; Cary N. Eskow, Morton Grove, both of Ill.

[73] Assignee: Keene Corporation, New York, N.Y.

[21] Appl. No.: 7,802

[22] Filed: Jan. 30, 1979

[51] Int. Cl.[3] ..... G07F 3/02

[52] U.S. Cl. ..... 194/102

[58] Field of Search ..... 194/99, 102, 100 A

[56] References Cited

U.S. PATENT DOCUMENTS

| | | | |
|---|---|---|---|
| 3,939,954 | 2/1976 | Collins | 194/102 |
| 3,980,168 | 9/1976 | Knight | 194/100 A |
| 4,148,388 | 4/1979 | Reyner et al. | 194/102 |

*Primary Examiner*—Stanley H. Tollberg

*Attorney, Agent, or Firm*—Albert L. Jeffers; John F. Hoffman

[57] ABSTRACT

An arrangement for determining the denomination-indicative size of a token, coin or the like independent of precise positioning of the coin is disclosed which may include a coin chute of generally rectangular cross-section for determining a general pathway along which coins may serially pass an array of optical sensors. The array includes a first sensor which is actuated by any coin entering the sensing region and the coin is identified, as to diameter and therefore also denomination, by the most remote of the other sensors actuated by the coin while the first sensor remains actuated. For larger coins only the first sensor and one remote sensor are employed while for certain smaller coins a plurality of sensors equidistant from the first sensor are employed making coin identification independent of exact coin position within the array. The array may be dimensioned so that the smallest coin to be sensed actuates no other coin denomination sensor within the array while it is actuating the first sensor. In one form, the sensors comprise aligned pairs of light sources and light sensitive devices, with blockage of the light pathway therebetween, indicating coin presence. The light sensitive devices are coupled to digital circuitry for processing information from the array to determine actual coin denomination.

20 Claims, 8 Drawing Figures

COIN IDENTIFICATION SYSTEM

BACKGROUND OF THE INVENTION

The present invention relates generally to a system for classifying a series of coins, tokens and the like, according to their denomination and more specifically to making such a classification determination according to the size of the coin.

Coin accepting devices are rather commonplace and include, for example, coin changers, laundromat equipment, vending machines, and the turnstiles or fareboxes associated with public transportation systems. Frequently the coin accepting device is mechanically configured to accept only certain denomination sizes, while other coin accepting devices may accept several different coins, and classify each coin according to a physical property of that coin. The weight of a coin may, for example, be used to determine its denomination, while some more sophisticated systems measure magnetic properties of the coin with still other systems making an optical determination of the coin size. This last category may be termed "optical coin identification".

The typical optical coin identifying system requires that the coin to be identified be precisely positioned as, for example, being against a fixed side wall or rail, and further requires that the coin be at a precise position along that engaged rail, whereupon its denomination is determined by a light sensing array and more specifically by the particular light sensors which are blocked by the coin, and the other particular light sensors which are not blocked by the coin. Such a sensing array is disclosed in U.S. Pat. No. 3,939,954.

Another optical coin identification system not requiring the coin being identified to be at a precise location is disclosed in the John A. Meyer copending patent application Ser. No. 900,497 assigned to the assignee of the present invention. This application is entitled "Token Identifying System" and the entire disclosure thereof is specifically incorporated herein by reference. In this copending application, an image of a passing coin chord is projected onto a linear array of light sensing elements and that linear array is repetitively scanned or interrogated to determine the maximum projected chord, with this maximum chord being interpreted as the coin diameter. The maximum coin chord identifying scheme of this copending application works well and functions independently of precise positioning of the coin as by a wall or rail, however, this maximum chord system is relatively complex and expensive to manufacture and maintain.

SUMMARY OF THE INVENTION

Among the several objects of the present invention may be noted the provision of a method and apparatus for determining the denomination-indicative size of each of a sequence of coins independent of precise coin position within the vicinity of a sensing array; the provision of a coin-sensing scheme not requiring precise coin positioning to determine coin diameter; the provision of a system for determining the denomination of each of a series of coins having the respective advantages of the aforementioned copending application and United States Patent while eliminating the respective disadvantages thereof; the provision of a system for identifying a moving coin according to its diameter as determined by the conjoint obscuration of a light sensing device obscured first by every passing coin and a diameter-determinative light-sensing device remote from the first-obscured light sensing device; and the provision of a coin-sensing system characterized by its ease and economy of manufacture, low maintenance and less stringent dimensional tolerance requirements. These as well as other objects and advantageous features of the present invention will be in part apparent and in part pointed out hereinafter.

In general, coins are moved serially past an array of optical sensors and the conjoint obscuration by a coin of a first sensor and at least one of a plurality of second sensors each at a common distance from the first sensor is determined. A further determination of the conjoint obscuration by the coin of the first sensor and a further sensor more remote from the first sensor than the plurality of second sensors is also made and for each such obscuration of the first sensor the coin denomination is identified according to the most widely separated sensor conjoint obscurations. Monitoring of one additional optical sensor and the first sensor will insure that two closely following coins are not identified as one larger coin.

Also in general and in one form of the invention, a sensor array for determining the denomination-indicative size of a token, coin or the like, independent of the precise token position within the vicinity of the sensor array includes a coin chute having a generally rectangular cross-section which determines a general pathway along which coins may move. A plurality of light sources and a like plurality of light sensors are disposed along opposite sides of the chute and in pairwise alignment so that each sensor is actuated by a correspondingly aligned light source so long as no coin obstructs the light pathway therebetween. A lesser number of light sources may be employed. For example, one light source in conjuction with a collimating lens may be used to illuminate the plurality of light sources.

When a coin obstructs a light pathway, the sensor of the pair is, of course, actuated to a state different from its normal or quiescent state, where the light-source illuminates the sensor. One light-source-sensor pair is positioned to have the light pathway therebetween temporarily blocked by any coin passing through the chute and this is facilitated by maintaining the chute cross-sectional length less than twice the diameter of the smallest coin to be sensed. This cross-sectional length may be made greater than twice the diameter of the smallest coin to be sensed, for example, by employing more than one array. The light pathways which are subsequently blocked during the time that the first light-source-sensor light pathway remains blocked are identified; and the particular light-source-sensor pair experiencing blockage during this time, most remote from that first light-source-sensor pair, is selected as indicating the coin denomination. Actual coin identification is accomplished by a plurality of digital circuits, each associated with a particular sensor, and switchable from one state to another upon the obstruction of its associated light pathway. When a plurality of sensors are associated with a particular denomination coin, their corresponding digital outputs are "OR" combined for coin-identifying purposes.

BRIEF DESCRIPTION OF THE DRAWING

Corresponding reference characters indicate corresponding parts throughout the several views of the drawings.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
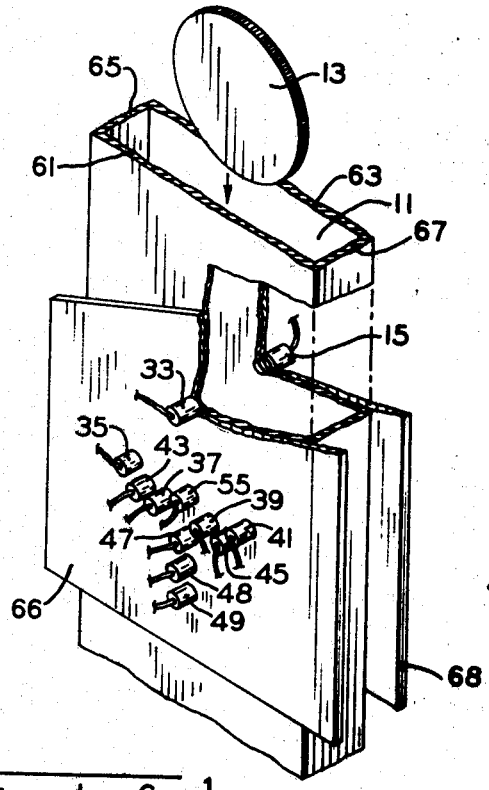
FIG. 1 is a perspective view of a portion of a coin chute partially broken away to illustrate the alignment of light sources and their corresponding sensors.
Figure 2:
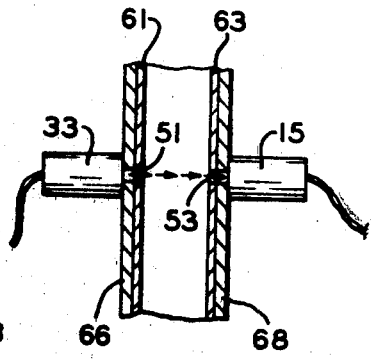
FIG. 2 is a view in section of one light source-sensor pair and the light pathway therebetween.
Figure 3:
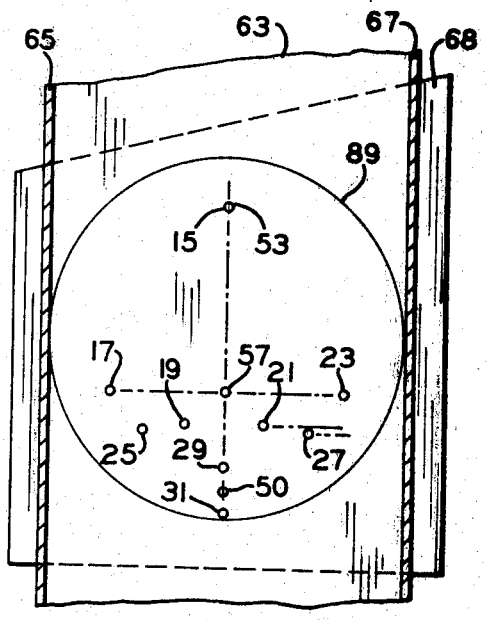
FIG. 3 is a view perpendicular to the plane of FIG. 2 illustrating the placement of light sensors within the coin chute.

Referring now to the drawing in general and particularly to FIGS. 1 and 3, the sensor array for determining the denomination-indicative size of each of a sequence of tokens, coins or the like, which terms are used with complete interchangeability throughout the disclosure, is seen to include a coin chute 11 having a generally rectangular cross-section which chute determines a general pathway along which coins such as 13 may pass, for example, under the influence of gravity. A plurality of light sensors 15, 17, 19, 21, 23, 25, 27, 29 and 31 are disposed to one side of the coin chute and in opposed alignment with a like plurality of light sources 33, 35, 37, 39, 41, 43, 45, 47 and 49, respectively. A common light source could be employed and a further sensor 50 and associated light source 48 may optionally be included for a dollar coin. The light source and its associated sensor are as illustrated in FIG. 2 positioned on the outboard sides of the chute with small apertures such as 51 and 53 providing a light pathway between the light source such as 33 and the associated light sensing element 15. Every light-source-sensor pair has a similar light pathway associated therewith and the sensor is actuated by obstruction of this light pathway. A "clear" light source 55 and associated sensor 57 are also included, the function of which will be described subsequently.

Figure 7A:
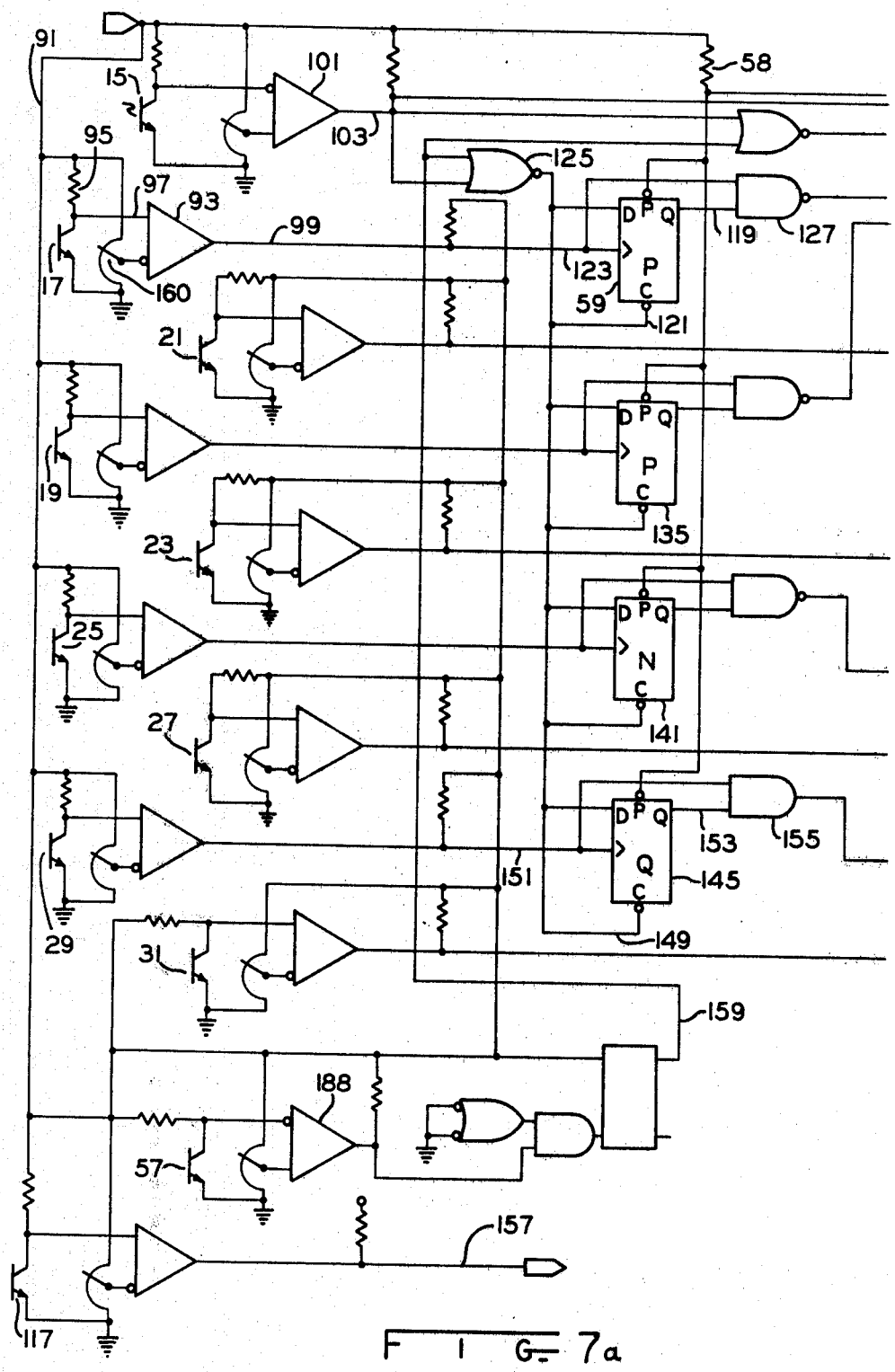
FIGS. 7*a* and 7*b* when joined with FIG. 7*a* to the left is a schematic diagram of the logic circuitry and coin sensors for identifying particular coins.
Figure 7B:
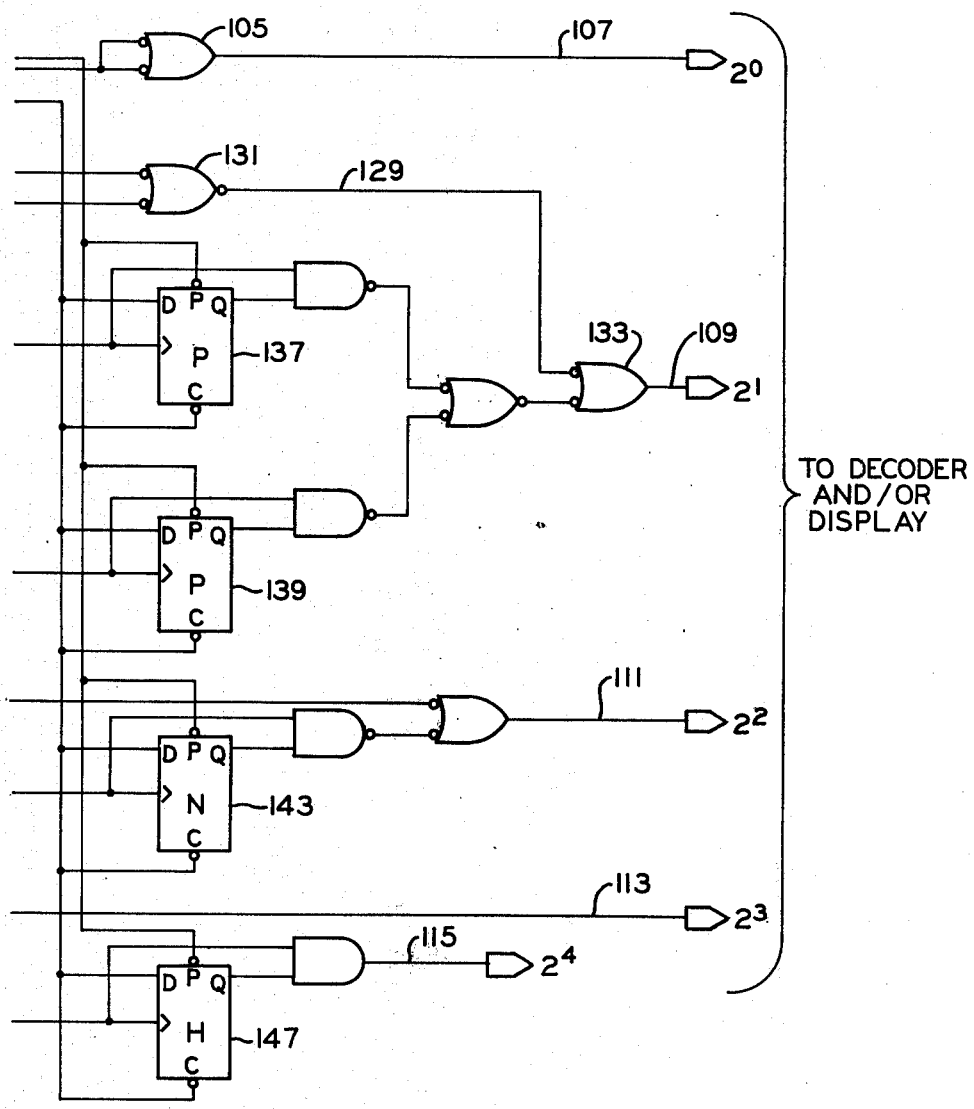

In FIG. 3 the sensor reference numerals point to the opening behind which the entire sensor is located, whereas in FIG. 7*a* the same sensor is illustrated as a phototransistor which is normally conducting due to the light incident thereon from the corresponding light source, but which is rendered non-conductive when its light pathway is obstructed by a coin. The circuitry of FIGS. 7*a* and 7*b* functions generally to identify light-source-sensor pairs with light pathways which become blocked during the time that the light pathway associated with sensor 15 remains blocked. It will be noted that sensor 15 is disposed centrally in the chute upstream of the other sensors and that the chute width is typically less than twice the diameter of the smallest coin to be sensed and hence every acceptable coin will block the light pathway associated with sensor 15. Such dimensioning while not essential does serve to guarantee that each coin will be measured.

The circuit of FIG. 7 includes a number of digital circuits such as 59 each of which has a binary output normally in one state and switchable to a second, coin-indicating state upon the occurrence of the obstruction of its associated light pathway when the light pathway associated with sensor 15 is blocked. Each digital circuit such as 59 has a "preset" terminal P and a "clear" terminal C as well as conventional D, Q and clock terminals with the "preset" terminal connected by resistor 58 to the positive 5 volt supply on line 91. The logic circuits in conjunction with further logic circuitry providing an "OR" function allows the circuit of FIG. 7 to provide an indication of coin denomination.

Referring now more specifically to FIGS. 1 and 2, the light source such as 33 may comprise a light emitting diode or a collimating lens and a common light source may serve several sensors with each light sensor comprising a phototransistor. The light-source-sensor pairs are mounted in opposition along the parallel walls 61 and 63 of the coin chute with the separation between these walls in one embodiment being about one-tenth of an inch. The actual light pathways as represented by the apertures 51 and 53 are about thirteen-thousandths of an inch in diameter in one form. An additional backing plate 66 for the mounting of the light sources as well as a similar backing plate 68 for mounting the light sensors may be included with a larger diameter aperture therein for each source or sensor.

FIGS. 3 through 6 are substantially similar views in section along a path cutting the flat parallel end walls, showing the openings and corresponding sensors therebehind in side wall 63 and mounting plate 68. In each of these Figures, the circular aperture and associated sensor are effectively the same and bear like reference numerals, except for sensor 15 and its associated aperture 33.

Figure 4:
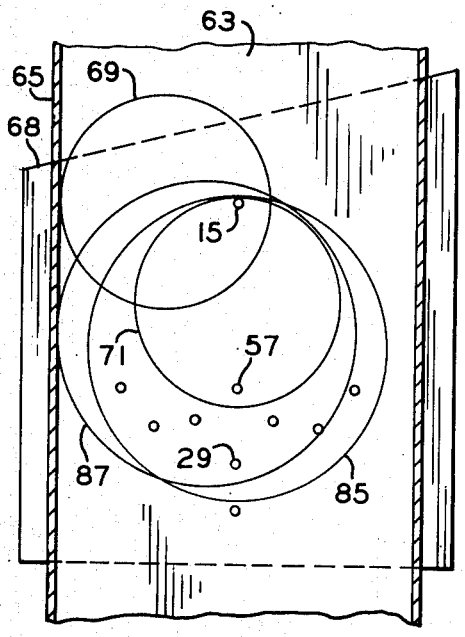
FIGS. 4, 5 and 6 are views of the sensor array within the coin chute similar to FIG. 3 but illustrating various exemplary positions of various denomination coins.

In FIG. 4, 69 and 71 illustrate two exemplary locations within the same array for the smallest coin to be identified. This coin, for example, a United States dime, is seen at 69 to always obscure the sensor 15 since the diameter of a dime is greater than one-half the length of the rectangular opening of the chute. A chute length opening of 1.250 inches was used in one implementation of a coin chute where the smallest coin to be sensed was a dime of 0.705 inch diameter, while the largest coin to be accepted by the chute was a half dollar of 1.205 inches diameter. The dime, as illustrated in position 71, is not sufficiently large to simultaneously actuate sensor 15 and any of the other sensors save the "clear" sensor 57.

Figure 5:
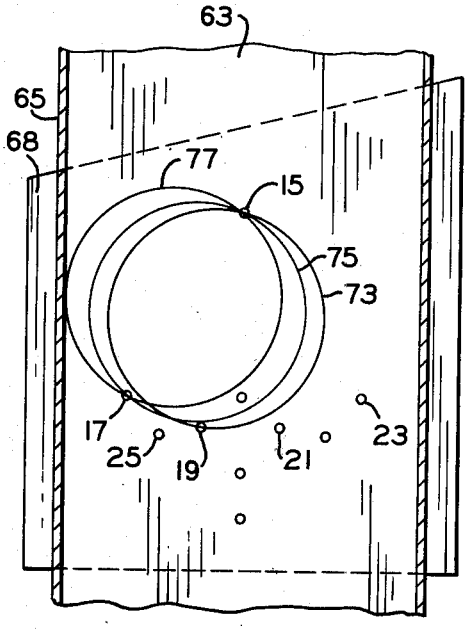

A United States penny, the next larger coin to be sensed, is illustrated in positions 73, 75 and 77 in FIG. 5, and it will be noted that in each of these positions, the penny is of sufficient diameter to simultaneously obscure sensor 15 and sensor 17 or sensor 19. In position 77, the penny is riding against chute end 65 and simultaneously obstructs, or actuates, sensors 15 and 17, while in position 75 the penny still simultaneously obstructs sensors 15 and 17. In position 73, the penny simultaneously obstructs and therefore actuates sensors 15 and 19. Note again that the penny must be at least of a diameter equal to the separation between sensors 15 and 19, plus about the diameter of the sensor opening to insure that both sensors may be simultaneously obstructed by the penny, however, the distance, for example, from sensor 15 to sensor 25 must be greater than the diameter of the penny. Sensors 21 and 23 are, of course, additional penny sensors.

Figure 6:
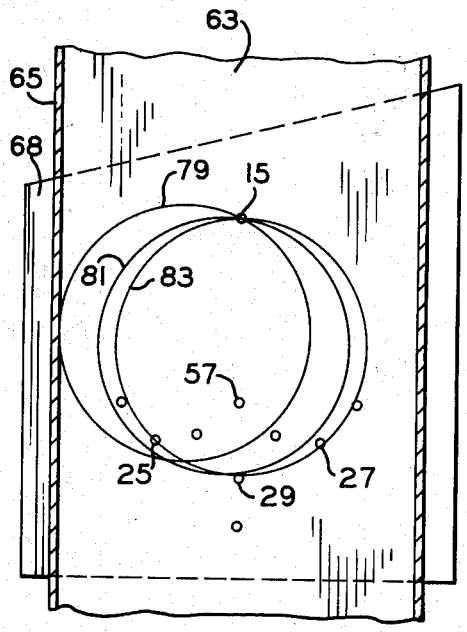

The nickel, in position 79 of FIG. 6, simultaneously actuates sensors 15 and 25, or, more precisely, actuates sensor 25 while sensor 25 is actuated while that same coin actuates those same sensors in position 81, and sensors 15 and 27 are actuated by the nickel in position 83. The nickel cannot, however, cover sensors 15 and 29 simultaneously. A quarter, illustrated in positions 85 and 87 of FIG. 4, is seen to always obstruct sensors 15 and 29, while a half dollar 89, as seen in FIG. 3, will always obstruct sensors 15 and 31, and is seen to nearly fill the coin chute.

The function of sensor 57 is not to identify any particular coin but rather is to cause the identifying circuitry to disregard a coin identification which might otherwise be caused by two serially moving coins which might otherwise yield an indication of a single large coin. This sensor 57 in essence clears any recorded coin indications. This "clear" function of sensor 57 occurs if sensor 15 is actuated then sensor 57 actuated (its light pathway blocked) and thereafter the light pathway for sensor 57 unblocked while sensor 15 remains actuated. The precise manner of implementing this "clear" function will become apparent from the discussion of FIG. 7.

The following table I lists in conventional Cartesian coordinate form the sensor opening center positions relative to an origin at sensor 15 with an X axis corresponding to the direction of coin passage from positive to negative (top to bottom). The function of the system is, of course, independent of the direction of coin motion with "upstream" and "downstream" being completely interchangeable. The Y axis has its positive direction toward the left of the sheet as viewed in FIGS. 3 through 6. The location of the optional dollar coin sensor could be included for completeness at (−0.971, 0). It will be noted that there are four penny sensors 17, 19, 21 and 23 symmetrically disposed about the X axis and at a substantially common distance of 0.721 inches from sensor 15, while there are two nickel sensors 25 and 27 again symmetrically disposed about the X axis and at a common distance of 0.765 inches from the origin.

TABLE I

| Clear | Dime | Penny | Nickel | Quarter | Half Dollar |
|---|---|---|---|---|---|
| (−.611, 0) | (0,0) | (−.611, −.384) | (−.270, −.716) | (−.851, 0) | (−1.100, 0) |
| | | (−.611, .384) | (−.270, .716) | | |
| | | (−.709, −.129) | | | |
| | | (−.709, .129) | | | |
| | | r=.721 | r=.765 | | |

It will be noted from the following table II that the penny sensors are at a distance just greater than the diameter of a dime from the origin, while the nickel sensors are at a common distance just greater than the diameter of a penny from the origin and in general, the denomination indicative sensors are disposed along an arc having a radius slightly less than the diameter of the associated coin but greater than the diameter of the next smallest coin to be received. It should also be noted that the separation between the chute ends for the dimensions in table I of 1.25 inches is just greater than the largest coin to be sensed; however, other sensors positioning will allow a different separation between the ends of the chute and these dimensions are illustrative only. The decoder input and output appearing in table II will be discussed in conjunction with FIG. 7.

TABLE II

| Coin Denomination | Coin Diameter | Decoder Input | Decoder Output |
|---|---|---|---|
| Half Dollar | 1.200 | 11111 | 31 |
| Quarter | .955 | 01111 | 15 |
| Nickel | .835 | 00111 | 7 |
| Penny | .750 | 00011 | 3 |
| Dime | .700 | 00001 | 1 |

In FIG. 7, the sensors are illustrated as phototransistors and carry the same reference numerals as used in FIGS. 3 through 6 to identify the exposed position of the respective sensors. Each sensor is biased, for example, by way of a resistor to a positive 5 volt supply on line 91, and is connected to the inputs of comparators such as 93 with each such comparator being connected in a differential mode with its inverting or negative input indicated by a circle at the input of the comparator. The phototransistors are conducting so long as they are illuminated and go non-conductive when that light source is removed, for example, by blockage of a corresponding light pathway by a coin. The input to each comparator further includes a biasing resistor such as 95 and potentiometer such as 160 to set an appropriate sensitivity for the sensor according to the intensity of its light source. Thus, for example, sensor 17 is normally conducting effectively grounding input line 97 and providing a low or "zero" output signal on line 99. When the light pathway to sensor 17 is blocked by a coin, the phototransistor becomes non-conductive, raising the voltage level on line 97 and providing a high or "one" output on line 99. Each of the comparators except comparators 101 and 188 functions in substantially the same manner. So long as phototransistor 15 is illuminated, conduction by that transistor provides a low input to the inverting or negative terminal of comparator 101, and when the light pathway associated with phototransistor 15 is blocked, the comparator 101 inverting input goes high, forcing the output on line 103 to go to its low or "zero" state. Thus this comparator provides a normally high output which goes low when the sensor light pathway is blocked. This low indicating signal is inverted by gate 105 to provide a high indication on line 107 indicative of coin passage and if no other output line 109, 111, 113 or 115 is high, indicative of the passage of the smallest coin sensible by the array.

For each sensor except 15, 57 and 117, the output of the corresponding comparator (type 339, for example) is supplied to a 7474 D-type flip-flop such as 59. Each of these flip-flops bears the legend P, N, Q or H indicating the particular coin denomination associated therewith, the flip-flop 59 being associated with a penny sensor 17. Each of these flip-flops has an output line such as 119 which goes high when its corresponding input on line 121 is in a high state, and the input on line 123 transitions from its low to its high state. Thus, for example, with sensor 15 obscured, the signal on line 103 is low and is inverted by gate 125 providing a high input to flip-flop 59 on line 121. If during this obscuration of sensor 15, sensor 17 is also obscured, line 99 goes high, causing an output or high signal on line 119. This high signal on line 119 and corresponding high signal on line 99 cause the output of NAND gate 127 to go low in turn causing a low output on line 129 from gate 131 which signal is inverted by gate 133 providing a high penny indication on line 109. A high output from any one or more of the penny flip-flops 59, 135, 137 or 139 will cause this same high, penny-indicative signal on line 109 with the pair of nickel flip-flops 141 and 143 operating in an analogous manner. There is only one quarter flip-flop 145 and one half dollar flip-flop 147 which function in much the same manner and, if a dollar coin sensor is provided, similar circuitry to identify that coin may be included. If a coin passes sensor 15 creating a high signal on input line 149 to flip-flop 145 and thereafter while that high input signal persists, sensor 29 is obscured, a high signal is supplied by way of line 151 to flip-flop 145 transitioning its output on line 153 to a high, quarter-indicative state. This signal is passed by way of AND gate 155 to provide a high or quarter indicative output signal on line 113.

Sensor 117 is located upstream of the sensors illustrated in FIGS. 1 through 6 and merely functions to detect the passage of a coin in an earlier part of the coin chute to actuate, for example, a mechanism for arranging the coins in single-file order to be passed through the sensing region while sensor 57, the "clear" sensor, provides an approximately 50 nanosecond pulse on line 159 to clear all old coin images from the flip-flops such as 59. This clear signal also causes the circuit to disregard a conjoint obscuration determination such as sensors 15 and 29 being simultaneously blocked if sensor 57, which is intermediate the two mentioned sensors, is not also obscured.

The outputs on line 107, 109, 111, 113 and 115 may merely be coupled to indicators and the highest denomination coin indicator actuated by the passage of any given coin could be selected as identifying the denomination of that particular coin. These five outputs may also be coupled to a five-bit-binary to one-out-of-thirty-two-matrix decoder with the decoder outputs being considered in order from top to bottom as sequentially more significant digits. Thus for a nickel there would be high signals on lines 107, 109 and 111, while lines 113 and 115 would be low, giving the binary number 00111 shown on table II. The decoder would convert this binary number to a single high output line being the output associated with the decimal number 7 and this line could supply a display or be otherwise used for accumulating a coin total or for other processing purposes.

From the foregoing is now apparent that a novel method of determining coin denomination, as well as a novel coin sensing array has been disclosed, meeting the objects and advantageous features set out hereinbefore, as well as others, and that modifications as to the precise configuration, shape and details may be made by those having ordinary skill in the art without departing from the spirit of the invention, or the scope thereof, as set out by the claims which follow.

What is claimed is:

1. The method of determining the denomination-indicative size of each of a sequence of coins comprising the steps of:

moving the coins serially past an array of optical sensors;

determining the conjoint obscuration by a coin of a first sensor and at least one of a plurality of second sensors each at a common distance from the first sensor;

determining the conjoint obscuration by a coin of the first sensor and at least one third sensor at a second distance more remote from the first sensor than the second sensors;

for each such obscuration of the first sensor, identifying the coin denomination according to the maximum conjoint obscuration distance; and monitoring another sensor intermediate the first sensor and the plurality of second sensors and disregarding a conjoint obscuration determination if the intermediate sensor is not also obscured.

2. The method of claim 1 wherein the step of identifying comprises identifying a coin as being the smallest, the next larger, or a still larger one of a series of acceptable size coins accordingly as only the first sensor was obscured by the coin, only the first sensor and at least one of the second sensors were obscured, and the first sensor and at least one third sensor were obscured by the coin.

3. The method of claim 1 including the further step of determining the conjoint obscuration by a coin of the first sensor and at least one of a plurality of fourth sensors each at a substantially common third distance from the first sensor, the third distance being greater than the first distance and less than the second distance.

4. The method of claim 3 including the further step of determining the conjoint obscuration by a coin of the first sensor and at least one fifth sensor at a fourth distance from the first sensor, the fourth distance being greater than the second distance.

5. The method of claim 4 wherein the passing of a coin obscures in order: the first sensor, at least one of the second sensors, at least one of the fourth sensors, a third sensor, and a fifth sensor.

6. The method of claim 4 wherein the step of identifying the coin denomination is effected in multiples of the United States cent accordingly as a passing coin simultaneously obscures the first sensor only, the first sensor and at least one of the second sensors only, the first sensor and one of the fourth sensors but not the third sensor nor the fifth sensor, the first sensor and the third sensor but not the fifth sensor, and the first sensor and the fifth sensor as ten, one, five, twenty-five and fifty cents respectively.

7. The method of claim 3 wherein the plurality of second sensors is four and the plurality of fourth sensors is two.

8. The method of claim 1 wherein the step of passing the coins includes confining the coins to a region sufficiently near the array that any acceptable coin when passing the array will obscure at least the first sensor.

9. A sensor array for determining the denomination indicative size of a token, coin or the like independent of precise token position within the vicinity of the array comprising:

a coin chute generally rectangular in cross-section for determining a general pathway along which coins may pass;

a light source and a plurality of light sensors disposed along opposite sides of the chute and in alignment with each sensor actuated by the light source so long as no coin obstructs the light pathway thereto;

one light sensor positioned to have the light pathway thereto temporarily blocked by any coin passing through the chute;

means identifying other sensors with light pathways subsequently correspondingly blocked during the time that the one sensor light pathway remains blocked including a plurality of digital circuits each having a binary output normally in a first state and switchable to a second coin indicating state upon the occurrence of the obstruction of an associated light pathway at a time that the light pathway of the one light sensor is blocked, there being four digital circuits and four associated light pathways for sensing passage of the next to the smallest coin detectable by the array, and two digital circuits and two associated light pathways for sensing passage of the next larger coin; and means selecting the identified sensor most remote from the one sensor and indicating the coin denomination associated therewith.

10. The sensor array of claim 9 wherein the light source comprises a plurality of light emitting diodes and each light sensor comprises a phototransistor.

11. The sensor array of claim 10 wherein the coin chute is formed by a pair of generally flat, parallel, side walls and a pair of generally flat, parallel, end walls, the side walls being provided with a plurality of opposed pairs of aligned openings, there being an opposed pair of openings for each light source-sensor pair.

12. The sensor array of claim 11 wherein each phototransistor and each light emitting diode is affixed to a side wall on the outer side of the chute and in optical alignment with a corresponding opening.

13. The sensor array of claim 11 wherein the openings are all circular in cross-section and of substantially the same diameter, the distance from the opening center associated with the said one light source-sensor pair to the opening center associated with a light source-sensor pair and corresponding particular denomination coin when added to the opening diameter being no larger than the minimum acceptable diameter of the particular denomination coin while this same sum is strictly greater than the diameter of the next smaller acceptable coin.

14. The sensor array of claim 9 wherein the smallest detectable coin while blocking the light pathway of the one light sensor leaves unobstructed the four light pathways for detecting passage of the said next to the smallest coin.

15. The sensor array of claim 9 further comprising a first OR logic circuit coupled to the outputs of the four digital circuits associated with the said next to the smallest coin to facilitate identification of said next to the smallest coin by blockage of any one of the four associated light pathways.

16. The sensor array of claim 15 further comprising a second OR logic circuit coupled to the outputs of the two digital circuits associated with the said next larger coin to facilitate identification of a said next larger coin by blockage of any one of the two associated light pathways, identification of a said next larger coin by the second OR circuit superseding a coin identification by the first OR circuit.

17. A sensor array for determining the denomination indicative size of a coin, token or the like independent of precise position within the array comprising:

a first sensor;

a plurality of second sensors associated with a first size coin and positioned along an arc at a substantially constant first distance from the first sensor;

a plurality of third sensors associated with a second size coin larger than the first size coin and positioned along an arc at a substantially constant second distance from the first sensor, the number of second sensors being greater than the number of third sensors, the second distance being greater than the first distance, the second size coin having a diameter greater than the second distance and the first size coin having a diameter less than the second distance and greater than the first distance;

means for providing a first indication when the first sensor and at least one of the second sensors simultaneously indicate the presence of the same coin; and means for providing a second indication when the first sensor and at least one of the third sensors simultaneously indicate the presence of the same coin.

18. The sensor array of claim 17 further comprising at least one fourth sensor associated with a third size coin larger than the second size coin and positioned at a third distance from the first sensor, the third size coin having a diameter greater than the third distance and the second size coin diameter being less than the third distance.

19. The sensor array of claim 17 wherein the number of second sensors is sufficiently great to insure that at least one second sensor senses the presence of any first size coin sensed by the first sensor.

20. The method of determining the denomination-indicative size of each of a sequence of coins comprising the steps of:

predetermining a set of different size coins to be sensed;

locating a first sensor in a reference position;

locating a plurality of second sensors associated with a first size coin along an arc at a substantially uniform first distance from the first sensor, the uniform first distance being greater than the diameter of at least one size coin in the set and less than the diameter of the first size coin;

locating a plurality of third sensors associated with a second size coin along an arc at a substantially uniform second distance from the first sensor, the second distance being greater than the diameter of the first size coin and less than the diameter of the second size coin; and locating additional sensors along sequentially remote arcs such that the distance from the first sensor to each such more remote arc is less than the diameter of a corresponding coin in the set and greater than the diameter of the next smaller coin in the set.

* * * * *